US012137794B2

(12) United States Patent
Dunbar et al.

(10) Patent No.: US 12,137,794 B2
(45) Date of Patent: Nov. 12, 2024

(54) ARMBAND FASTENING ASSEMBLY FOR A WEARABLE ACCESSORY ARM STRAP

(71) Applicant: Hand Held Products, Inc., Charlotte, NC (US)

(72) Inventors: Blake E. Dunbar, Philadelphia, PA (US); Emily N. Cort, Collingswood, NJ (US); Joanna Kucko, Charlotte, NC (US)

(73) Assignee: HAND HELD PRODUCTS, INC., Charlotte, NC (US)

( * ) Notice: Subject to any disclaimer, the term of this patent is extended or adjusted under 35 U.S.C. 154(b) by 101 days.

(21) Appl. No.: 17/659,408

(22) Filed: Apr. 15, 2022

(65) Prior Publication Data

US 2023/0329426 A1 Oct. 19, 2023

(51) Int. Cl.
*A45F 5/00* (2006.01)

(52) U.S. Cl.
CPC ..... *A45F 5/00* (2013.01); *A45F 2005/008* (2013.01); *A45F 2200/0516* (2013.01)

(58) Field of Classification Search
CPC ..... A45F 2005/008; A45F 2200/0516; A45F 2200/0525; Y10S 224/93; H04B 1/385
USPC ..... 224/930
See application file for complete search history.

(56) References Cited

U.S. PATENT DOCUMENTS

| | | | | |
|---|---|---|---|---|
| 9,693,622 | B1 * | 7/2017 | Hackett | A45C 11/00 |
| 2013/0235546 | A1 * | 9/2013 | Sedillo | G06F 1/163 361/809 |
| 2015/0238343 | A1 | 8/2015 | Joseph | |
| 2016/0174674 | A1 * | 6/2016 | Oberpriller | A45C 11/00 224/191 |

FOREIGN PATENT DOCUMENTS

EP 2400935 B1 11/2019

OTHER PUBLICATIONS

European search report Mailed on Sep. 13, 2023 for EP Application No. 23162025, 8 page(s).
Amazon, 5 Pcs Detachable Long Lanyard Neck Strap—Ideal for Mobile Cell Phone/Smartphones/Phone Case/Camera/Key and Any Other Electronic Devices with a Lanyard Hole—Black, https://www.amazon.in/Detachable-Long-Lanyard-Neck-Strap/dp/B07KQTBGZ7, 8 pgs.

(Continued)

*Primary Examiner* — Adam J Waggenspack
(74) *Attorney, Agent, or Firm* — Alston & Bird LLP

(57) ABSTRACT

An example fastening assembly for attaching a wearable accessory arm strap device holder is provided. An example fastening assembly may include a tab defining a distal end and a proximal end, the proximal end connected to a portion of an outer body. The tab may have a first material. The example fastening assembly may further include an inner body having a second material. The inner body and the tab may receive a cord therebetween. At least a portion of the inner body may deform during insertion of the cord between the tab and the inner body. In another example, a wearable accessory arm strap device holder including a fastening assembly is provided. An example method of attaching a device to the arm of a user, utilizing a fastening assembly, is further included.

17 Claims, 11 Drawing Sheets

(56) References Cited

OTHER PUBLICATIONS

Zebra, TC5X Series Configuration & Accessories Guide, https://www.zebra.com/content/dam/zebra_new_ia/en-us/solutions-verticals/product/Mobile_Computers/Hand-Held%20Computers/tc5x-tc7x-series/guides/tc5x-guide-configuration-and-accessories-en-us.pdf, 28 pgs, (Mar. 16, 2022).
Zebra, WT6000 / WT6300 RS4000 / RS5000 / RS6000 RS5100, Accessories Guide, https://www.zebra.com/content/dam/zebra_new_ia/en-us/solutions-verticals/product/Mobile_Computers/Wearable%20Computers/guide-accessory/wearable-computers-guide-accessory-en-us.pdf, 35 pgs.

* cited by examiner

ARMBAND FASTENING ASSEMBLY FOR A WEARABLE ACCESSORY ARM STRAP

TECHNOLOGICAL FIELD

Embodiments of the present disclosure relate generally to an armband fastening assembly configured to easily attach a mobile device to an object such as a user's arm.

BACKGROUND

Applicant has identified many technical challenges and difficulties associated with attaching a mobile device to a mobile device user's arm or other appendage. Through applied effort, ingenuity, and innovation, Applicant has solved problems related to these wearable accessory arm straps by developing solutions embodied in the present disclosure, which are described in detail below.

BRIEF SUMMARY

Various embodiments are directed to an example fastening assembly for a wearable accessory arm strap device holder as well as a method for attaching a wearable accessory arm strap device holder.

In accordance with some embodiments of the present disclosure, an example fastening assembly is provided. In some embodiments, the fastening assembly may comprise a tab defining a distal end and a proximal end, the proximal end connected to a portion of an outer body. In some embodiments, the tab may comprise a first material and an inner body comprising a second material. In some embodiments, the inner body and the tab may be configured to receive a cord therebetween. In some embodiments, at least a portion of the inner body may be configured to deform during insertion of the cord between the tab and the inner body.

In some embodiments, the tab may define a first protrusion at or proximate the distal end, the protrusion extending at least partially towards the inner body.

In some embodiments, the portion of the inner body may comprise a protrusion, wherein the protrusion is configured to deform at least partially towards the proximal end of the tab during insertion of the cord.

In some embodiments, the fastening assembly may comprise a cord, wherein the cord is configured to be pulled between the tab and the inner body to deform the portion of the inner body.

In some embodiments, a gap may be defined between the tab and the portion of the inner body, wherein the gap may be smaller than the width of the cord.

In some embodiments, the gap between the tab and the portion of the inner body may be closed by applying pressure to the fastening assembly.

In some embodiments, the portion of the inner body may comprise a rib extending between two other portions of the inner body.

In some embodiments, the rib may extend perpendicular to a longitudinal axis of the tab.

In some embodiments, the rib may be configured to remain fixed to the two other portions at opposite ends of the rib while a middle portion between the opposite ends may be configured to deform along at least an upper edge of the rib.

In some embodiments, the tab may be comprised of a rigid plastic and the inner body may be comprised of an elastomeric material.

In some embodiments, the tab may be a single integral piece with the outer body.

An example wearable accessory arm strap device holder comprising a fastening assembly is further included. In some embodiments, the example device holder comprises an outer body comprising a tab defining a distal end and a proximal end, the proximal end connected to a portion of the outer body. In some embodiments, the tab may comprise a first material. In some embodiments, the device holder may further comprise an inner body comprising a second material. In some embodiments, the inner body and the tab may be configured to receive a cord therebetween, wherein at least a portion of the inner body may be configured to deform during insertion of the cord between the tab and the inner body. In addition, in some embodiments, the outer body further comprises a device carriage configured to hold a mobile device therein. Further, in some embodiments, a device holder may further comprise a strapping mechanism comprising a cord, wherein the strapping mechanism may be configured to attach the device holder to an object.

In some embodiments, the device holder may further comprising four tabs, including the tab connected to the outer body, wherein the strapping mechanism may be configured to engage each of the four tabs.

In some embodiments, the strapping mechanism may further comprise a portion of material having a first end and a second end, and four loops of cord, including the cord, wherein two of the four loops of cord are disposed at or proximate the first end and a second two of the four loops of cord are disposed at or proximate the second end, wherein each of the four loops of cord is configured to engage a respective one of the four tabs.

In some embodiments, the strapping mechanism may be configured to close a gap between the tab and the inner body via tightening the strapping mechanism against the object.

In some embodiments, the cord of the strapping mechanism may comprise a loop, wherein the loop is configured to engage the tab by being disposed over the distal end of the tab.

In some embodiments, the strapping mechanism may further comprise a band and at least one loop of cord attached to the band. In some embodiments, the loop of cord may be configured to engage the tab and the band may be configured to pass around the object.

In some embodiments, the device holder may further comprise a second tab, wherein the object comprises a user arm and wherein the tab may be disposed on a first side of the outer body and the second tab may be disposed on a second side of the outer body opposite the first side. In some embodiments, the tab and the second tab may be oriented in different directions, wherein the strapping mechanism is configured to attach to the tab disposed on the first side of the outer body, pass around the user arm, and attach to the second tab disposed on the second side of the outer body and wherein a gap between the tab and the inner body is closed when the strapping mechanism is tightened against the user arm.

An example method of attaching a device to an arm of a user is further included. The example method may comprise providing a device holder. The device holder may comprise, an outer body comprising a plurality of tabs, including a first tab and a second tab, the plurality of tabs defining a distal end and a proximal end, the proximal end connected to a portion of the outer body, and the plurality of tabs comprising a first material. The device holder may further comprise an inner body comprising a second material wherein the inner body and the first tab are configured to receive a cord therebetween, wherein at least a portion of the inner body is configured to deform during insertion of the cord between the first tab of the plurality of tabs and the inner body, and wherein the outer body comprises a device carriage configured to hold a mobile device therein. The device holder may further comprise a strapping mechanism comprising the cord. In some embodiments, the method may further comprise passing the strapping mechanism around the arm of the user and attaching the strapping mechanism to the first tab.

In some embodiments, the first tab may be disposed on a first side of the outer body and the second tab may be disposed on a second side of the outer body opposite the first side and the method may further comprise attaching the strapping mechanism to the second tab; and tightening the strapping mechanism against the arm of the user thereby closing gaps defined between each of the plurality of tabs and the inner body.

BRIEF DESCRIPTION OF THE DRAWINGS

Reference will now be made to the accompanying drawings. The components illustrated in the figures may or may not be present in certain embodiments described herein. Some embodiments may include fewer (or more) components than those shown in the figures in accordance with an example embodiment of the present disclosure.

DETAILED DESCRIPTION

Figure 1:
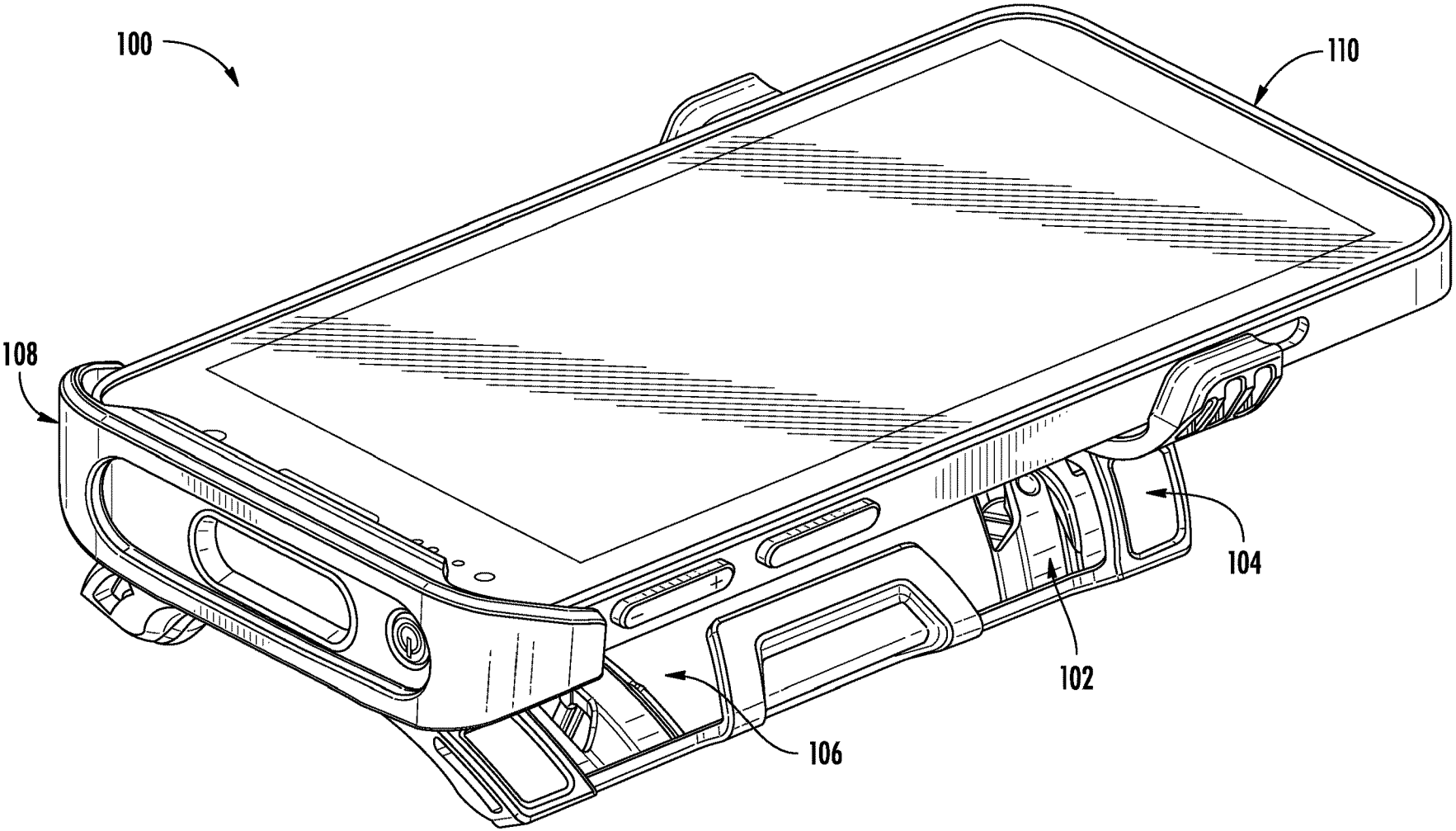
FIG. 1 illustrates a perspective view of an example device holder attached to a mobile device in accordance with an example embodiment of the present disclosure.

Example embodiments will be described more fully hereinafter with reference to the accompanying drawings, in which some, but not all embodiments of the inventions of the disclosure are shown. Indeed, embodiments of the disclosure may be embodied in many different forms and should not be construed as limited to the embodiments set forth herein; rather, these embodiments are provided so that this disclosure will satisfy applicable legal requirements. Like numbers refer to like elements throughout.

Various example embodiments address technical problems associated with attaching and operably holding a mobile device to an object, such as a user's arm. As understood by those of skill in the field to which the present disclosure pertains, there are numerous scenarios in which it is beneficial to attach a mobile device to an object, such as a user's arm. Attaching a mobile device to a user's arm, for example, allows the user the benefit of continued use of their hands while utilizing a mobile device while minimizing the risk of damage or loss of the mobile device. The positioning of the mobile device that is created by the device holders and various fastening mechanisms disclosed herein may also allow improved, intuitive functioning of the mobile device, such as hands-free scanning of decodable indicia. Many devices used to attach a mobile device to a user's arm are difficult to securely attach without the use of both hands. In addition, many devices may be tailored for a right-handed or left-handed attachment and not easily utilized on either hand. Further, many devices become loose or easily detach during use. One skilled in the field to which the present disclosure pertains will appreciate further problems that may be resolved by various embodiments of the present disclosure.

The various embodiments herein, including but not limited to a device holder, which may be embodied as a wearable accessory arm strap, utilize various features to make attaching a mobile device simple and secure. For example, in some embodiments, a device holder may include at least two components, an inner body made of an elastomeric material and a rigid outer body including rigid tabs for attachment. The rigid tabs may define a rigid protrusion over which a cord, for example an elastic cord, may be passed for purposes of attaching the mobile device carriage to a user's arm. The inner body may include one or more protrusions (e.g., a rib or ribs) positioned opposite the rigid tabs which consist of a concentrated portion of material that stiffens the elastomeric material at the point at which the cord passes between the rigid tab and the inner body. In addition, the rigid tab may include a protrusion (e.g., a barb) opposite the rib on the inner body, defining a narrow gap through which the cord passes. In some embodiments, the narrow gap defined between the protrusion (e.g., a barb) and the rib may be smaller than the width of the cord when the device holder is not attached to the user's arm. In such embodiments, when the cord is pulled through the narrow gap, the cord and/or the rib on the inner material, temporarily deform to allow passage of the cord through the narrow gap. Once through the narrow gap, the cord and rib may return to their original form, securing the cord in place. In such embodiments, tension is required to loop the cord fully around the tab and the tab, in combination with the inner body, act to at least somewhat resist removal of the cord from between the tab and the inner body.

In addition, in some embodiments, the device holder disclosed herein may include a strapping mechanism with one or more corded loops for attaching to one or more tabs on the fastening device. By providing a narrow gap of deformable material, a user may loop the cord on the strapping mechanism over the rigid tab and pull the cord through the narrow gap (deforming the cord and/or the rib) with one hand. Once all the corded loops of the strapping mechanism are attached to a rigid tab and pulled through the narrow gap, a user may tighten the strapping mechanism against their arm, such that the narrow gap narrows further or completely disappears (e.g., the protrusion of the outer body and the rib of the inner body make contact) further securing the cord in place.

As a result of the herein described embodiments and in some examples, the device holder may be easily attached on either arm (or any other similarly sized object, including appendages or inanimate objects) with one or two hands and may remain securely in place. In operation, the inner body may rest on the user's arm, while the strapping mechanism applies tension to the tab(s) and, thereby, the outer body to compress the inner body between the outer body and the user's arm.

FIG. 1 illustrates a perspective view of an example device holder 100 according to various embodiments described herein. The device holder 100 is configured to, in some examples, attach a mobile device 110 to an object (e.g., a user's arm 804 shown in FIG. 8B) to facilitate use of the mobile device 110 without occupying one or both of the user's hands. It will be appreciated that the illustrated device holder 100 and various depicted embodiments herein are provided as example embodiments and should not be construed to narrow the scope or spirit of the disclosure in any way.

The depicted device holder 100 of FIG. 1 includes an inner body 104 and an outer body 106 layered atop the inner body 104, where the inner body 104 may be attached to the underneath side of the outer body 106. In addition, the outer body 106 depicted in FIG. 1 incorporates a device carriage 108 capable of holding a mobile device 110. In addition, the device holder 100 may include one or more fastening assemblies 102 as shown in FIG. 1, positioned to attach the device holder 100 to a user's arm 804.

Figure 2:
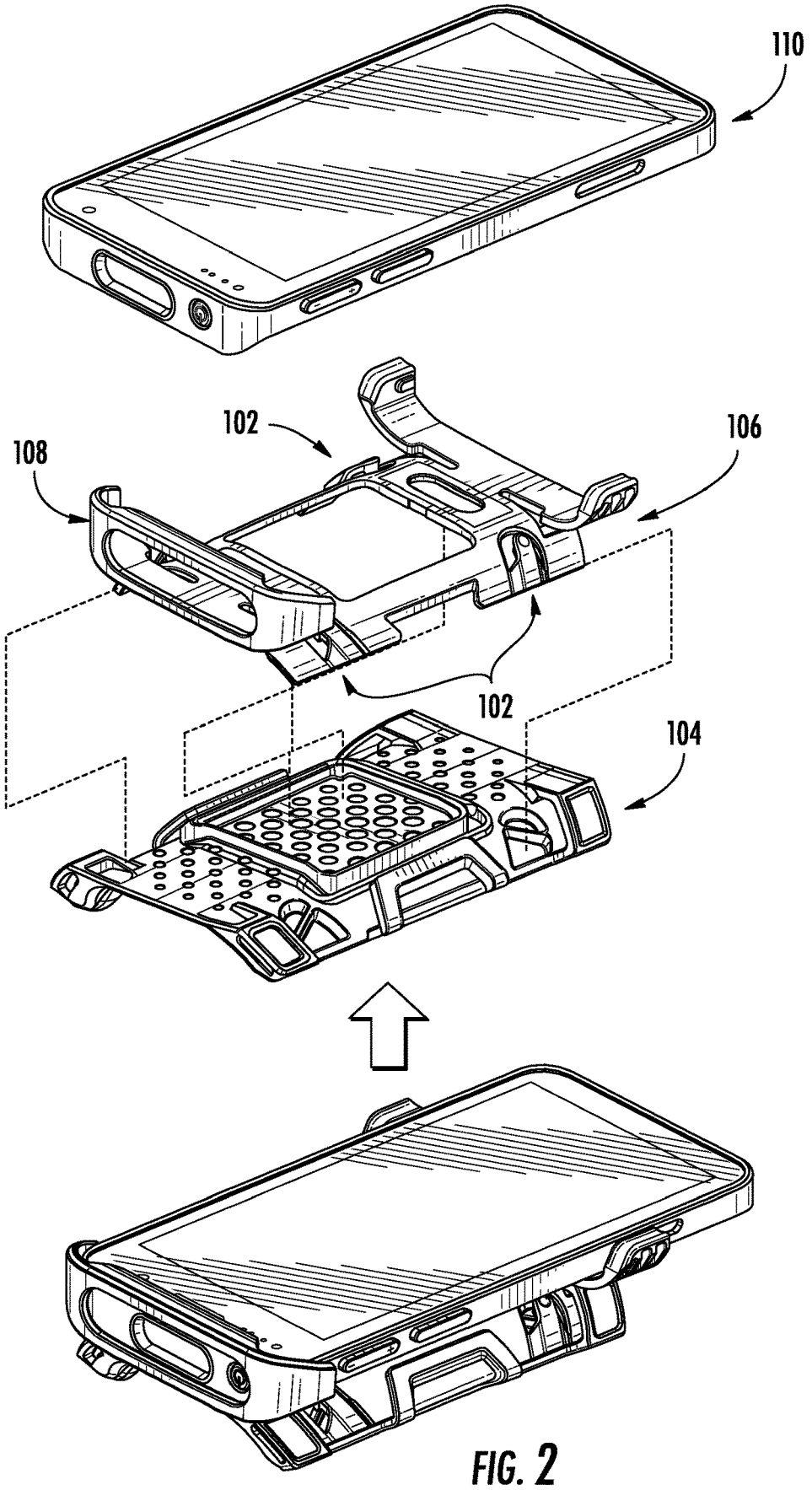
FIG. 2 illustrates and exploded view of a device holder and a mobile device in accordance with an example embodiment of the present disclosure.

FIG. 2 illustrates an exploded view of an example device holder 100 in accordance with an embodiment of the present disclosure. The depicted device holder 100 of FIG. 2 includes an inner body 104 positioned underneath an outer body 106. The depicted outer body 106 may be further adapted to incorporate a device carriage 108 capable of supporting a mobile device 110. In some embodiments, the device holder 100 may be symmetric about its center, longitudinal axis.

Figure 3:
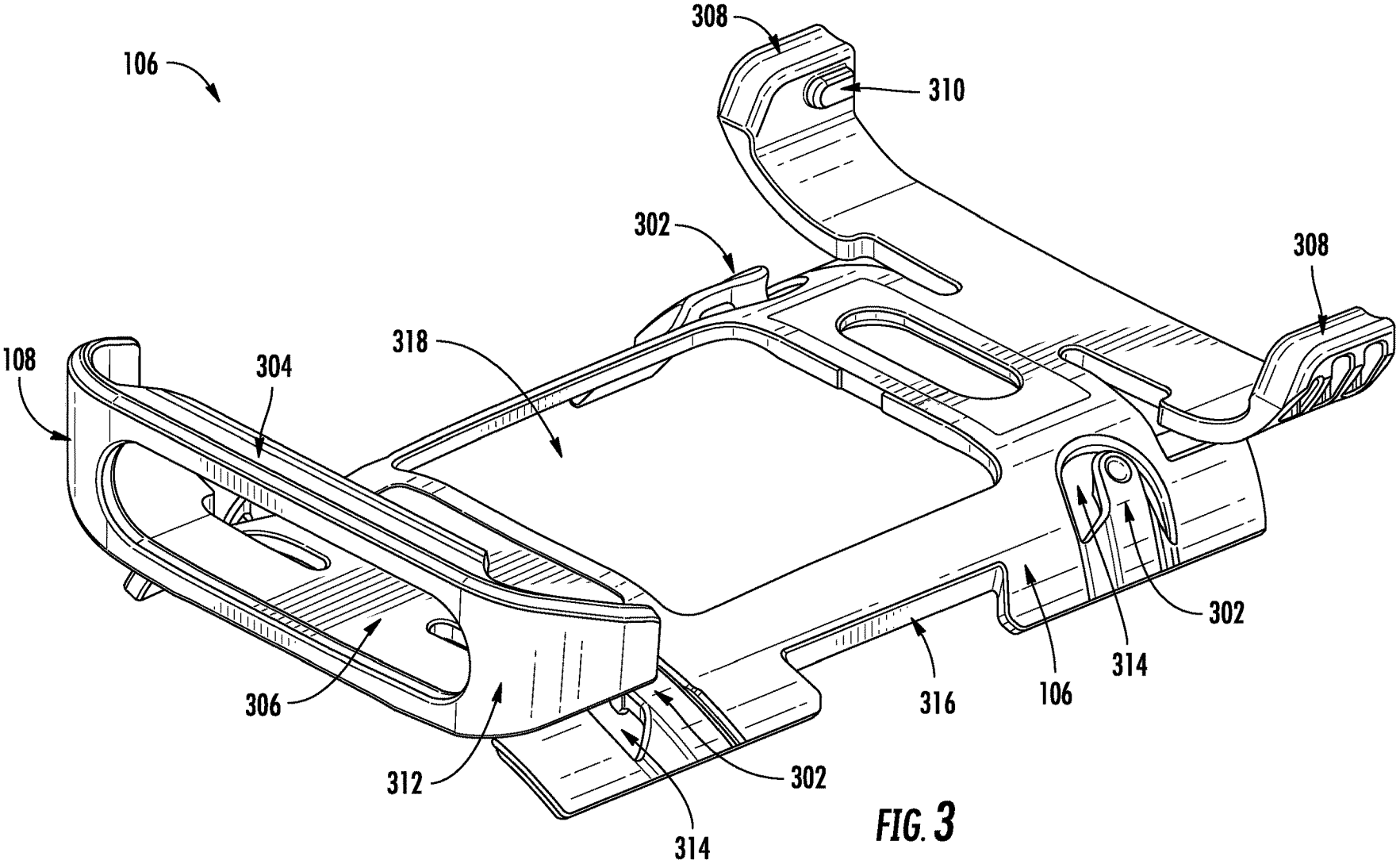
FIG. 3 illustrates a perspective view of an example outer body of a device holder comprising a device carriage in accordance with an example embodiment of the present disclosure.

FIG. 3 illustrates a perspective view of an example outer body 106 incorporating a device carriage 108 in accordance with an embodiment of the present disclosure. The outer body 106 may comprise coupling elements configured to align and/or attach the outer body 106 with the inner body 104. For example, an attaching edge 316 of the outer body 106 may be configured to attach to a correspondingly shaped side attaching feature 504 of the inner body 104 (e.g., the depicted embodiment is "dovetail" shaped). Further, the mobile device opening 318 may be configured to align with the mobile device support portion 506 of the inner body 104, which may aid with alignment and/or may provide a padded, non-skid, and breathable surface of the inner body 104 on which the attached mobile device 110 can rest. In addition, in some embodiments, the outer body 106 may comprise a second opening, for example, the oval shaped opening adjacent to the mobile device opening 318 allowing the inner body 104 to further contact the attached mobile device 110. Allowing the softer inner body 104 to contact the attached mobile device 110 may also apply light pressure to the mobile device 110, closing gaps between the mobile device 110 and the device carriage 108 and further securing the mobile device 110.

As depicted in FIG. 3, an outer body 106 may be any structure comprising and capable of supporting a tab 302 as part of a fastening assembly 102. In the depicted embodiment of FIG. 3, the outer body 106 rigidly connects and comprises four tabs 302 for engaging the strapping mechanism as disclosed herein. In some embodiments, the outer body 106 may be formed of a rigid plastic or other rigid material, for example, engineered plastics (e.g., thermoplastics and thermosets), carbon fiber, fiberglass, metal alloys, wood, and other similar materials. In some embodiments, the outer body 106 may be comprised of a mix of rigid and non-rigid materials. As used herein, the term "rigid" does not necessarily require absolute rigidity. For example, even "rigid" metals and plastics may deform elastically and/or inelastically under a sufficiently high force; however, the rigid outer body portions may not flex to such a degree that the cord is released under expected operating conditions. The term "rigid" encompasses all materials at least sufficiently rigid that the force exerted on the tab by the cord does not exceed the ultimate strength of the outer body material.

In some embodiments, at least the tabs 302 and a portion of the outer body(ies) 106 adjacent the tabs that rest on the inner body 104 may be rigid such that the tab 302 is configured to be held in a generally fixed position (e.g., apart from expected material deformation given expected tolerances and operating ranges) relative to the inner body 104 during operation. In some embodiments, the outer body 106 may be formed or shaped to fit the user's arm 804 to which the device holder 100 will be attached. For example, an inner surface of the outer body 106 may define an at least partially concave shape. In the depicted embodiment, the outer body 106 includes a generally flat central portion of the inner surface and concave outer edge portions of the inner surface. In some embodiments, the outer body 106 may provide openings to facilitate air flow to the user's arm 804 and/or the mobile device 110; to reduce the weight of the outer body 106; to align the inner body 104 with the outer body 106; to provide access to the underlying inner body 104 and/or the user's arm 804; and/or provide airflow to the mobile device 110. While depicted in FIG. 3 as a single outer body 106 comprising multiple fastening assemblies 102, in some embodiments, there may be multiple outer bodies 106 fastened together, or otherwise connected, to define a device holder 100, and the outer bodies 106 in such embodiments may be directly or indirectly (e.g., via the inner body 104) connected.

FIG. 3 further illustrates a device carriage 108 formed as part of the outer body 106. A device carriage 108 may be any structure or device configured to engage a mobile device 110 and secure the mobile device 110 to the remainder of the device holder 100. As depicted, a device carriage 108 may comprise a front portion 312 configured to support an end of the mobile device 110. The front piece may comprise a front opening 306 providing access to the ports, buttons, emitters, and/or sensors of the mobile device 110. In some embodiments, the front opening 306 may comprise a window for permitting the mobile device to emit light, radio frequency (RF), or other frequency wave and a receiver for receiving the reflected wave, for example, in support of enabling a bar code scanner or other function to operate therethrough. The front portion 312 of the device carriage 108 may further comprise a front flange 304 configured to hold the mobile device 110 in a fixed position. The device carriage 108 may further comprise two edge protrusions 308 configured to extend to the edges of the mobile device 110. Each edge protrusion 308 may further comprise an edge nub 310 configured to engage a slot, or indentation on the mobile device 110 to hold the mobile device 110 in position. As further depicted in FIG. 3, in some embodiments, the device carriage 108 may be an integral part of the outer body 106. In other embodiments, the device carriage 108 may be a separate body or feature that may be attached to the remaining components of the device holder 100 (e.g., to the outer and/or inner bodies) to secure the mobile device 110. In some embodiments, the device carriage 108 may consist of a rigid material formed to securely attach to the mobile device 110. As noted above, the "rigid" material may still include some ability to flex (e.g., to snap the mobile device into the device carriage). In some embodiments, the device carriage 108 may be adjustable, for example, the edge protrusions 308 may be able to extend or retract, increasing and decreasing the distance between the two edge protrusions 308. Such an adjustment may permit the device carriage 108 to securely hold mobile devices 110 of different sizes. Still, in other embodiments, the device carriage 108 may consist of a non-rigid material. For example, a device carriage 108 may consist of a strap or a sleeve configured to attach the mobile device 110 to a user's arm 804. In some embodiments, the device carriage 108 may define openings such that ports, buttons, and/or the screen of the mobile device 110 may still be accessible to a user. In some embodiments, the device carriage 108 may be attached or an integral part of the outer body 106 (e.g., as a single piece or multiple pieces), while in other embodiments, the device carriage 108 may be attached to the inner body 104 (e.g., as a single piece or multiple pieces), or any other portion of the device holder 100 to provide secure attachment of a mobile device 110.

FIG. 3 further illustrates a tab 302. As depicted in FIG. 3, a tab 302 may be formed as part of the outer body 106. The tab 302 may define a distal end detached from the outer body 106 and a proximal end connected to the remainder of the outer body. In some embodiments, the outer body 106 may define an opening 314 under and/or around the detached end of the tab 302 as shown in FIG. 3, exposing the underlying inner body 104 of the device holder 100. In some embodiments, the tab 302 may comprise the same material as the outer body 106, for example, a rigid plastic material. In some embodiments, the tab 302 may be elevated compared to the surrounding surface of the outer body 106 allowing for easier entry of a cord 802 around the tab 302. In some embodiments, a greater gap or opening may be defined between the inner body 104 and the tab 302 than between the inner body 104 and other portions of the outer body 106, which gap may expand and contract depending upon the tension on the tab 302 and the reaction force from the user's arm 804 as described herein. In some embodiments, the tabs 302 may be angled with the proximal end of the tab 302 pointed towards a front-to-back center portion (e.g. band 1004) of the strapping mechanism 1002 (shown in FIG. 10). For example, each of the two front tabs 302 (e.g., the two tabs closest to the front opening 306) may be rotated such that their proximal portions are oriented at least partially rearward, and the two rear tabs may be rotated the opposite direction such that their proximal portions are oriented at least partially forward. Positioning the tab 302 at an angle may align the tabs with the direction of force being applied by the strapping mechanism, providing greater security and maximum force tolerance toward the center of the strapping mechanism 1002 and further facilitating securing the device holder 100 to the user's arm 804. In such embodiments, the corresponding ribs 502 of the inner body 104 (shown in FIG. 5) may be similarly angled to remain at a predetermined angle (e.g., perpendicular) to the longitudinal axis of the tab 302 as shown by the varying angles in FIG. 5.

Figure 4:
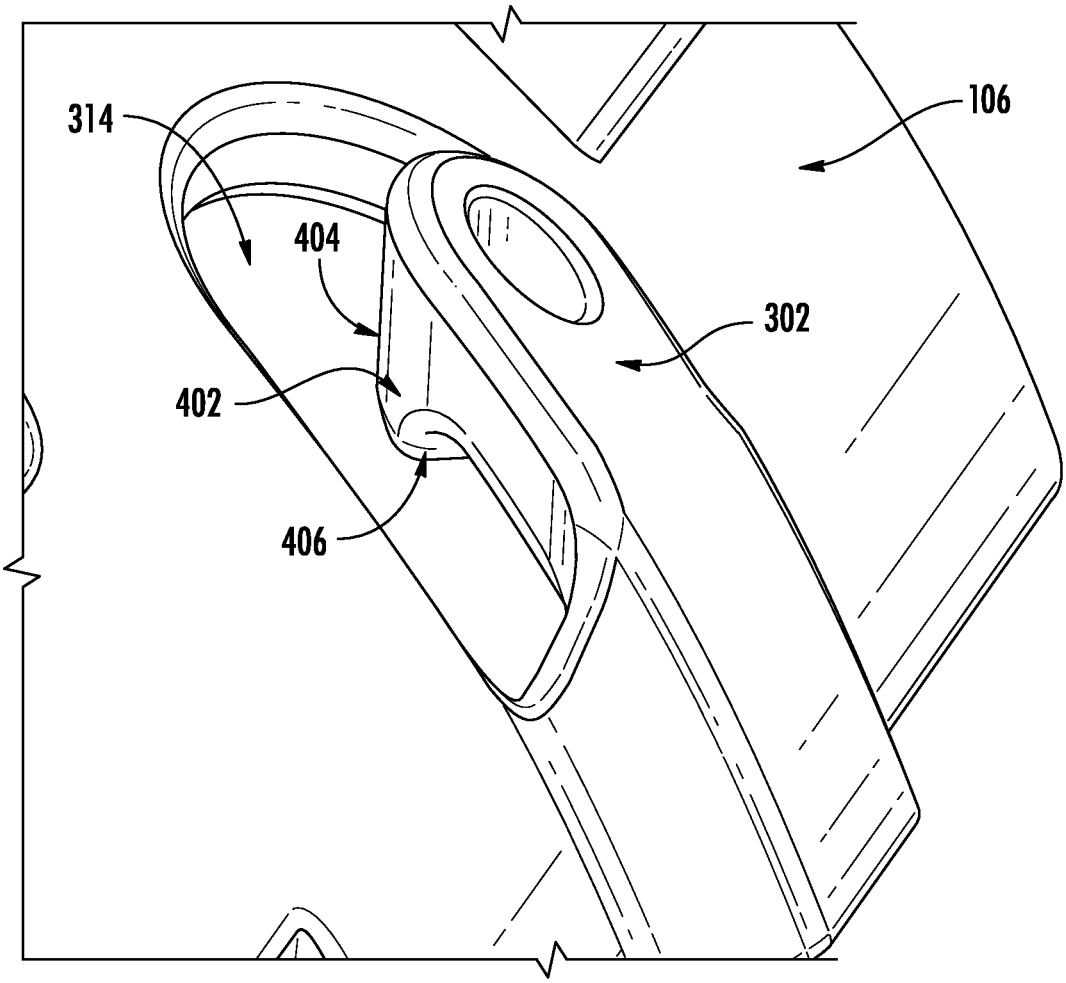
FIG. 4 illustrates a close-up view of an example tab in accordance with an example embodiment of the present disclosure.

FIG. 4 illustrates a partial view of the outer body 106 of FIG. 3 showing a tab 302. One end of the depicted tab 302 (e.g., a proximal end) is connected to the remaining portion of the outer body 106 and a second end is detached from the outer body 106 defining an opening 314 between the detached end of the tab 302 and the rest of the outer body 106. In FIG. 4, the tab 302 is integral with and formed as part of the remainder of the outer body. In some embodiments, the tab may be separately formed and may be attached to the outer body.

FIG. 4 also depicts a first protrusion (e.g., barb 402) protruding from the distal end of the tab 302 toward the inner body 104 of the fastening assembly 102 (not shown in FIG. 4). The barb 402 may be configured to extend toward the inner body 104, reducing a gap 702 (shown in FIG. 7) existing between the tab 302 and the inner body 104 under at least some conditions. In some embodiments, the barb 402 may comprise the same material as the tab 302, for example, a rigid plastic. In the depicted embodiment, the barb 402 is formed as an integral part of the tab 302. In some embodiments, the barb 402 may be formed of a different material from the tab 302, for example, a softer material capable of deforming when interacting with a cord 802 forced through the gap 702 between the outer body 106 and the inner body 104. In some embodiments, the barb 402 may be formed of a material providing a smooth surface allowing a cord 802 to pass through the gap 702 with reduced resistance. In some embodiments, the barb 402 may comprise a chamfered edge 404 (e.g., an edge surface angled at least partially towards the proximal end of the tab relative to a perpendicular angle) on the distal side of the barb 402 at the distal end of the tab 302 as shown in FIG. 4, forcing a cord 802 with an exerted force against the barb 402 to push down and through the gap 702 defined between the tab 302 and the inner body 104. In some embodiments, the inner edge 406 of the barb 402 closer the attached end of the tab 302 may be nearly perpendicular to the top surface of the tab 302 adjacent the distal end, providing a secure lock of the cord 802 after the cord 802 has passed through the gap 702 defined between the tab 302 and the inner body 104 and further depicted in FIG. 7 and FIGS. 8A-8B.

Figure 5:
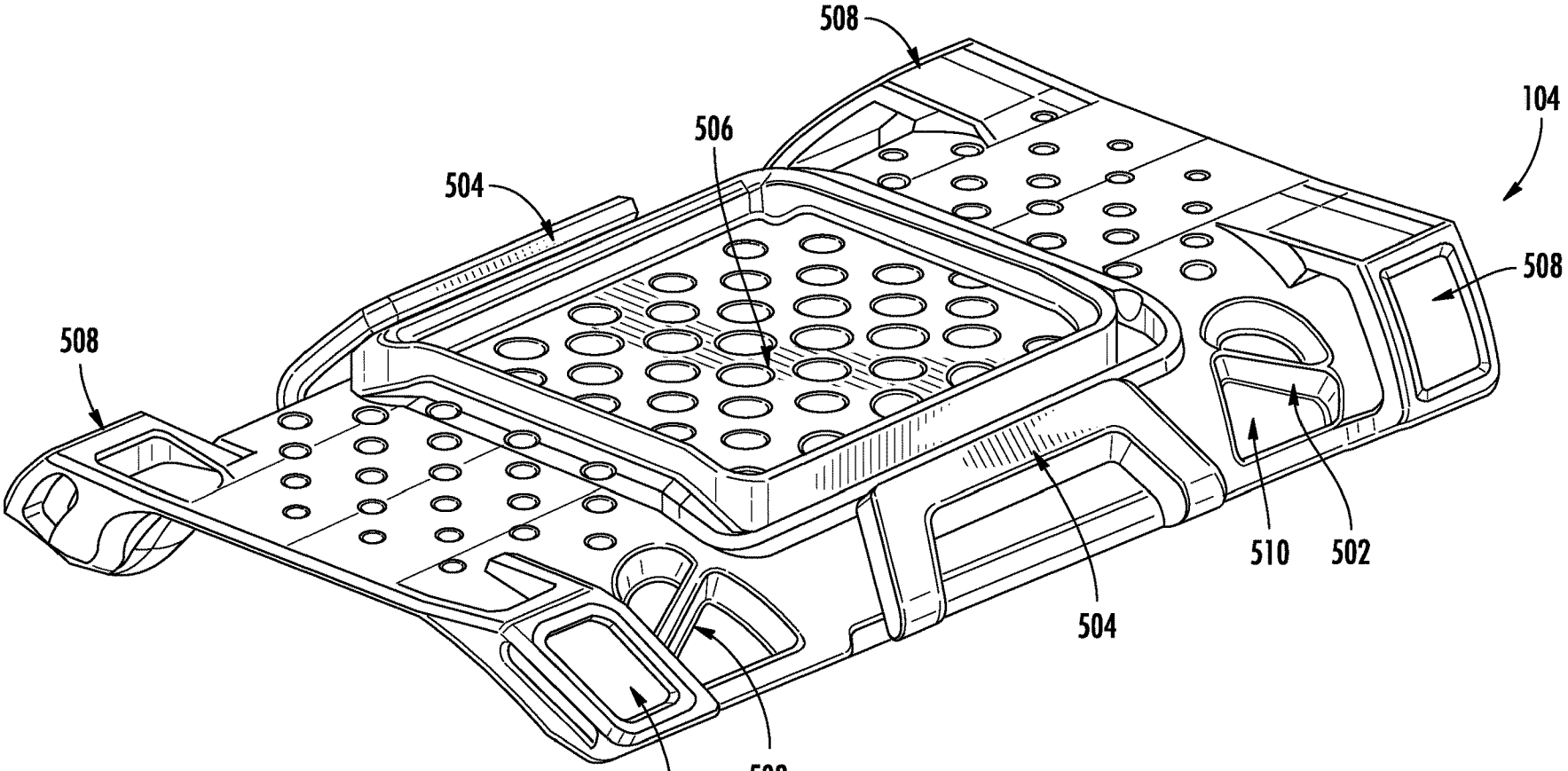
FIG. 5 illustrates a perspective view of an example inner body of a device holder in accordance with an example embodiment of the present disclosure.

FIG. 5 illustrates a perspective view of an example inner body 104 of a device holder 100, including a second protrusion (e.g., a rib 502) representing the inner body 104 portion of a fastening assembly 102.

FIG. 5 illustrates a perspective view of the inner body 104. An inner body 104 may be any structure capable of providing a deformable protrusion (e.g., rib 502) capable of allowing a cord 802 or other attaching mechanism to at least partially retain a cord when coupled with an outer body 106. An inner body 104 may further comprise side attaching features 504, a mobile device support portion 506, and outer body support protrusions 508 for aligning the outer body 106 with the inner body 104.

In some embodiments, the inner body 104 may be formed entirely of an elastomeric material having a softer durometer than the outer body, such as silicone, rubber, or softer durometer thermoplastic elastomers. In some embodiments, the inner body 104 may be comprised of a mix of softer durometer materials and more rigid materials. In some embodiments, the inner body 104 may be formed of a material to provide padding between the outer body 106 and a user's arm 804 to which the mobile device 110 is attached. In some embodiments, the inner body 104 may be comprised of a breathable material allowing airflow to the user's arm 804. An inner body 104 may further provide openings or perforations to allow airflow for the user's arm 804 and/or the mobile device 110. In some embodiments, the mobile device support portion 506 of the inner body 104 may further provide a padded surface on which a mobile device 110 may be positioned. In some embodiments, the inner body 104 may be formed to securely attach to the outer body 106, for example with a latching mechanism such as depicted in FIG. 5, wherein the side attaching feature 504 attaches to the attaching edge 316 of the outer body 106. In some embodiments, the inner body 104 is held constrained by the attaching edge 316 and a gap is created by the offset between the upper surface of the inner body 104 and the bottom surface of the outer body 106. The gap may close when attached to the user's arm as discussed herein. In some embodiments, the inner body 104 may be permanently attached to the outer body 106, for example, with an adhesive or other permanent attachment. In some embodiments, the outer body support protrusions 508 may be configured to provide support to the outer body 106 and define a gap between the inner body 104 and the outer body 106 at the fastening assembly 102 location. In the embodiment depicted in FIG. 5, each of the outer body support protrusions 508 define a front-to-back channel therethrough, which channel receives a corresponding corner engagement protrusion (shown in FIG. 3) of the outer body. These protrusions may facilitate alignment and support between the inner and outer bodies. In addition, in some embodiments, the outer body support protrusions 508 may act as a load bearing surface for the upper bendable portion of the outer body 106.

Figure 6:
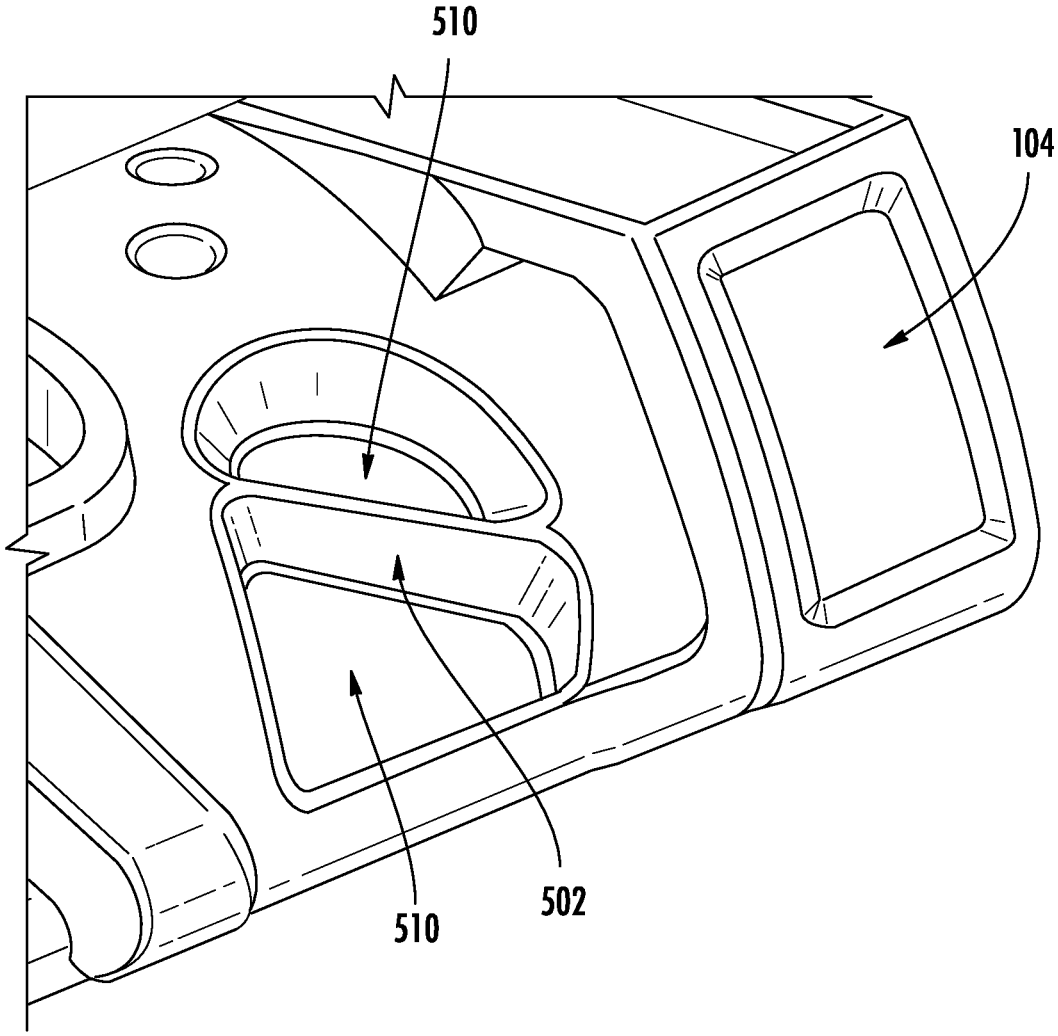
FIG. 6 illustrates a close-up view of an example inner body portion of a fastening assembly in accordance with an example embodiment of the present disclosure.

FIG. 5 further illustrates a second protrusion (e.g. a rib 502). A rib 502 may be any portion of material that provides resistance to a cord 802 passing through a gap 702 present between the inner body 104 and the outer body 106 of the fastening assembly 102. The rib 502 may provide resistance by deforming when pressure is applied to the surface or side of the rib 502 (e.g., when the cord is thicker than the gap). In some embodiments, the deformation of the rib 502 may be elastic deformation. In other embodiments, the rib 502 may deform by swinging on a hinge point or otherwise pivoting to provide a larger opening for a cord 802 to pass by. In some embodiments, the deformation may occur only at or near the lateral center of the rib 502, while in other embodiments, the entire rib 502 may deform or move when pressure is applied. In some embodiments, the rib 502 may be defined flush with portions of the surface of the inner body, and in some embodiments, recesses 510 may be formed on either side of the rib 502 as shown in FIG. 5 to allow the rib to deform. In other embodiments, a rib 502 may be comprised of an elevated portion of material of the inner body 104, elevated above the surface of the surrounding inner body 104. As depicted in FIG. 6, the rib 502 may extend between two other portions of the inner body 104, for example, forming a bridge between the two other portions while the surface of the inner body 104 surrounding the rib 502 in locations other than along the length of the rib may be depressed, sunk, or otherwise lower than the rib to form recesses 510. As further depicted in FIG. 7, a fastening assembly 102 is defined by associating a rib 502 on the inner body 104 with a tab 302 and/or barb 402 on the outer body 106, forming a gap 702 between the inner body 104 and the outer body 106. In some embodiments, the rib 502 may extend in a direction that is perpendicular or at least partially perpendicular to the insertion direction of the cord. In some embodiments, the rib 502 may extend in a direction that is perpendicular or at least partially perpendicular to the tab 302 (e.g., while both the tab and inner body may be curved at the location of the fastening assembly, the rib may be perpendicular within this curved reference frame). In some embodiments, the angle of the longitudinal axis of the tab 302 may be in line with the angle of the loops of cord 802 of the strapping mechanism 1002 (shown in FIG. 10). In some embodiments, the angle may vary such that the longitudinal axis of the tab 302 remains substantially aligned with the pull direction of the cord 802, with the longitudinal axis of the tab 302 remaining less than 20 degrees askew either side of the pulling direction. While some embodiments described herein may refer to the rib 502 as deforming in response to force from the cord, some embodiments may additionally or alternatively have a deformable portion of material on the outer body (e.g., a deformable barb).

Figure 7:
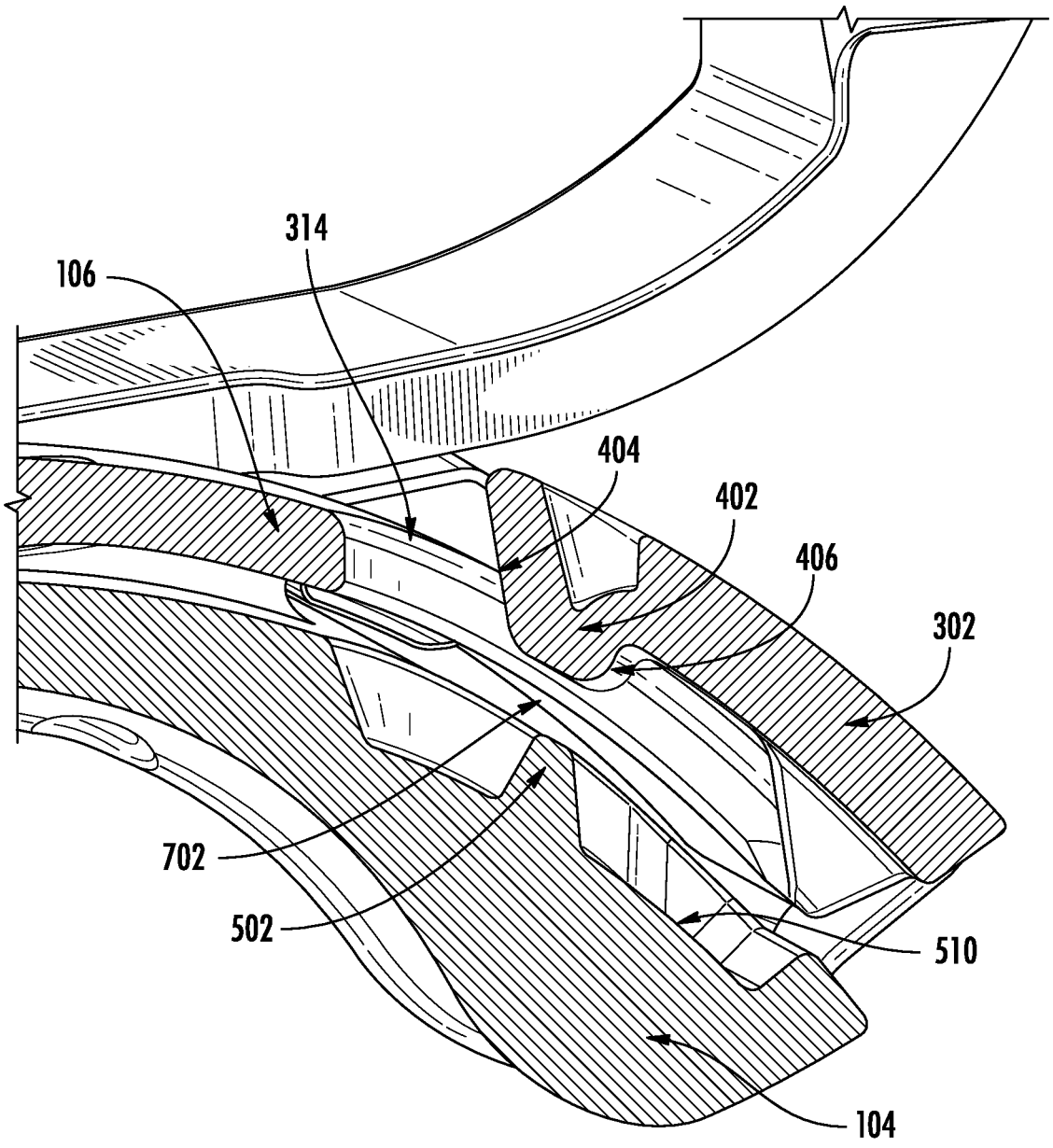
FIG. 7 illustrates a cross-sectional view of an example fastening assembly in accordance with an example embodiment of the present disclosure.

FIG. 7 illustrates a cross-sectional view of an example embodiment of a fastening assembly 102 of a device holder 100. As depicted in FIG. 7, a rigid tab 302 may have one end attached to the remainder of the outer body 106 and a second, distal end extending into an open area of the outer body 106. As further depicted in FIG. 7, at least a portion of the outer body 106 and the inner body 104 may be separated at the portion where the tab 302 extends over the inner body 104 creating a cavity between the tab 302 and the inner body 104, which includes the gap 702. In addition, the tab 302 depicted in FIG. 7 comprises a first protrusion (e.g., barb 402) extending from the detached, distal end of the tab 302 toward the inner body 104. Opposite the barb 402, disposed on the inner body 104, is a second protrusion (e.g., rib 502) defining a gap 702 between the barb 402 and the rib 502. The rib 502 may comprise a softer material (e.g., silicone) such that the rib 502 may be deformed when pressure is applied by a cord 802 or similar attaching structure. In some embodiments, the fastening assembly 102 may include only a single one of the rib 502 or barb 402, or the fastening assembly 102 may include neither the rib 502 nor the barb 402.

FIG. 7 illustrates a gap 702. A gap 702 may be any opening between the tab 302 and rib 502 that allows an attaching cord to pass between the inner body 104 and the outer body 106 to be held between the two to help facilitate securing the device holder 110 to an object. In some embodiments, as illustrated in FIG. 7, the tab 302 may comprise the barb 402, and the barb 402 may define a boundary of the gap 702 between the inner body 104 and the tab 302. In some embodiments, the gap 702 may be narrower than the width of the cord, in some instances even after the cord has deformed under pressure, and at least the rib 502 may deform in order for the cord 802 to pass through. Such a narrow gap 702 may require applied force to pass the cord 802 (shown in FIG. 8) through the gap 702. In such embodiments, the cord 802 may not become easily disengaged from the fastening mechanism during use.

Figure 8A:
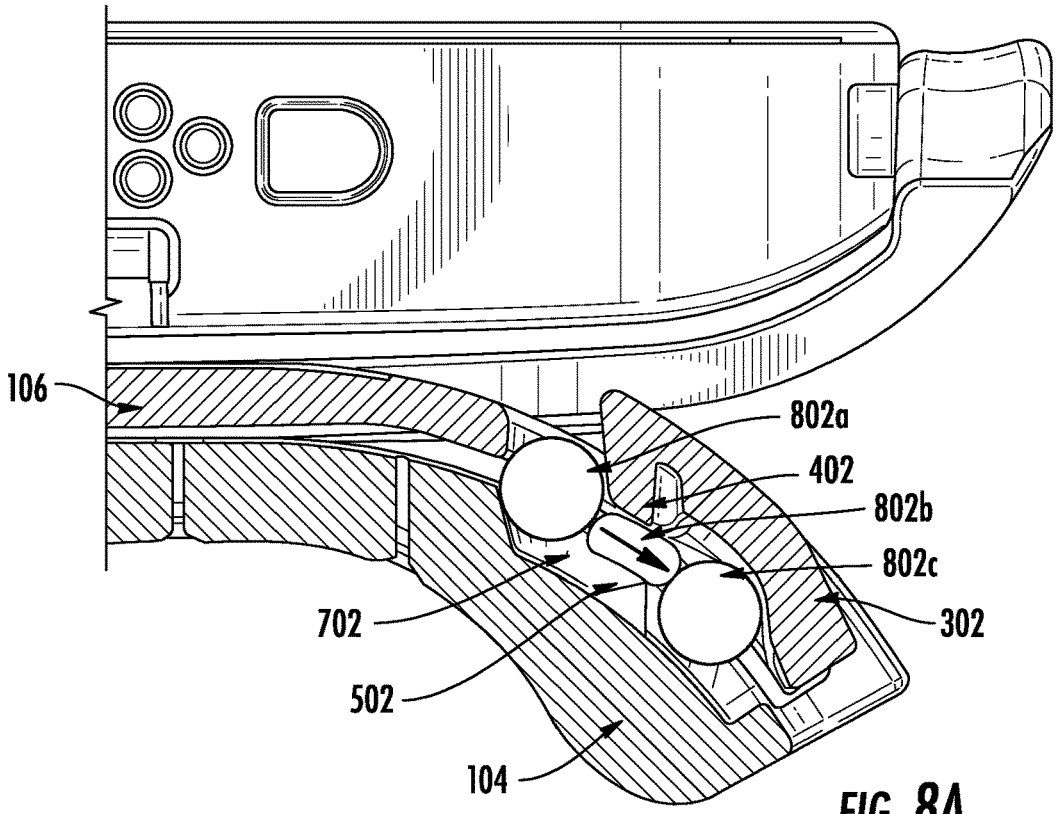
FIG. 8A illustrates a cross-sectional view of a cord passing through the gap defined between the tab and a rib of the inner body while the rib temporarily deforms in accordance with an example embodiment of the present disclosure.

FIG. 8A illustrates a cross-sectional view of a cord 802 passing through a gap 702 defined between the rib 502 defined on the inner body 104 and the barb 402 defined on the tab 302 of the outer body 106. FIG. 8A depicts the cord 802 at three example positions during the attachment process, including a first position 802*a* at which point the cord 802 has passed through the space between the tab 302 and the remainder of the outer body 106 before passing through the gap 702 between the barb 402 and the rib 502. At a second position 802*b*, both the rib 502 and the cord 802 are shown deformed (e.g., elastic deformation) as force is applied in the insertion direction (e.g., at least partially towards the proximal end of the tab) to allow the cord 802 to pass through the gap 702 between the rib 502 and the barb 402.

At position 802*c*, the cord 802 has returned to its resting form after passing through the gap 702 and into the cavity defined between the tab 302 and the inner body 104. In addition, the rib 502 returns to a resting position, again defining a narrow gap between the rib 502 and the barb 402. In this position, the rib 502 of the inner body 104 and/or the barb 402 of the outer body 106 provide at least some resistance to the cord 802 being removed (e.g., requiring a similar application of force and deformation to remove). This resistance may facilitate one-handed operation of the device holder 100 because a user can individually insert cords over the respective tabs 302 of the device holder 100 without the cords falling off before the device holder 100 is fully attached.

Figure 8B:
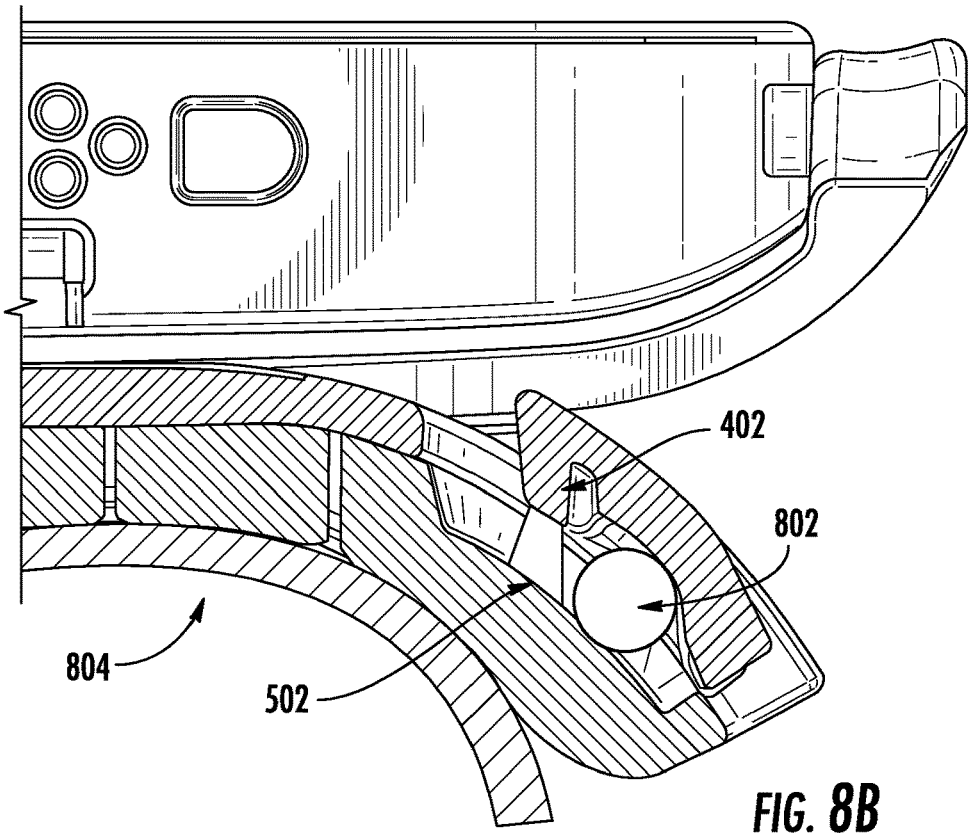
FIG. 8B illustrates a cross-sectional view of the gap between the tab and the rib closing in accordance with an example embodiment of the present disclosure.

FIG. 8B illustrates a cross-sectional view of the gap between the tab and the rib being completely closed after the cord 802 has passed through the gap 702 and the inner body 104 presses against the object (e.g., a user's arm 804) while the cord 802 rests in the cavity between the tab 302 and the inner body 104. FIG. 8B further depicts the object (e.g. a user's arm 804) adjacent the inner body 104 on the side opposite the outer body 106. As force is applied to the inner body 104 from the user's arm 804 due to the force of the strapping mechanism acting on the outer body 106, the gap 702 between the rib 502 and the barb 402 is forced narrower or entirely closed by, for example, compression of the inner body 104 against the outer body 106. In some embodiments, the force is applied by tightening the strapping mechanism 1002 attached to the fastening assemblies 102. In some embodiments, the "tightening" may occur naturally without further action when all of the cords or other attachment mechanisms are connected to their respective fastening assemblies. In some embodiments, the strapping mechanism may comprise any tightening mechanism, such as a hook and loop fastening strap defined between the cords, to allow adjustment of the tension between fastening assemblies and cords. Tightening the strapping mechanism 1002 pulls the outer body 106 toward the user's arm 804 sandwiching the inner body 104 between the outer body 106 and the user's arm 804. Once the gap 702 between the rib 502 and the barb 402 is narrowed or closed, the cord 802 is held in position by an even greater resistance to removal (e.g., it is much more difficult to remove the cord when the inner body and outer body are compressed towards each other than prior to attachment on the user's arm), securely fastening the mobile device 110 to the user's arm 804. While the embodiment depicted in FIG. 8B illustrates the device holder 100 attaching to a user's arm 804, the device holder 100 may be attached to any object, including a user's leg, a pole or other stationary object, and/or any other similar object to which the device holder 100 may be attached. Although depicted as completely closing in the embodiment of FIGS. 8A-8B, various embodiments of the present disclosure contemplate that the gap may narrow in any amount or degree (or not at all) upon attachment of the device holder 110 to the object (e.g., the user's arm 804), which may increase the removal resistance of the device holder depending upon the degree of closing. In various embodiments, either or both of (1) the deformable portions of the inner body 104 and/or outer body 106 (e.g., protrusions, such as ribs 502 and/or barbs 402) and/or (2) the compressible distance between portions of the inner body 104 and portions of the outer body 106 may facilitate easy insertion of the cords and secure holding of the cords in the fastening assemblies 102 of the device holder 110.

Figure 9:
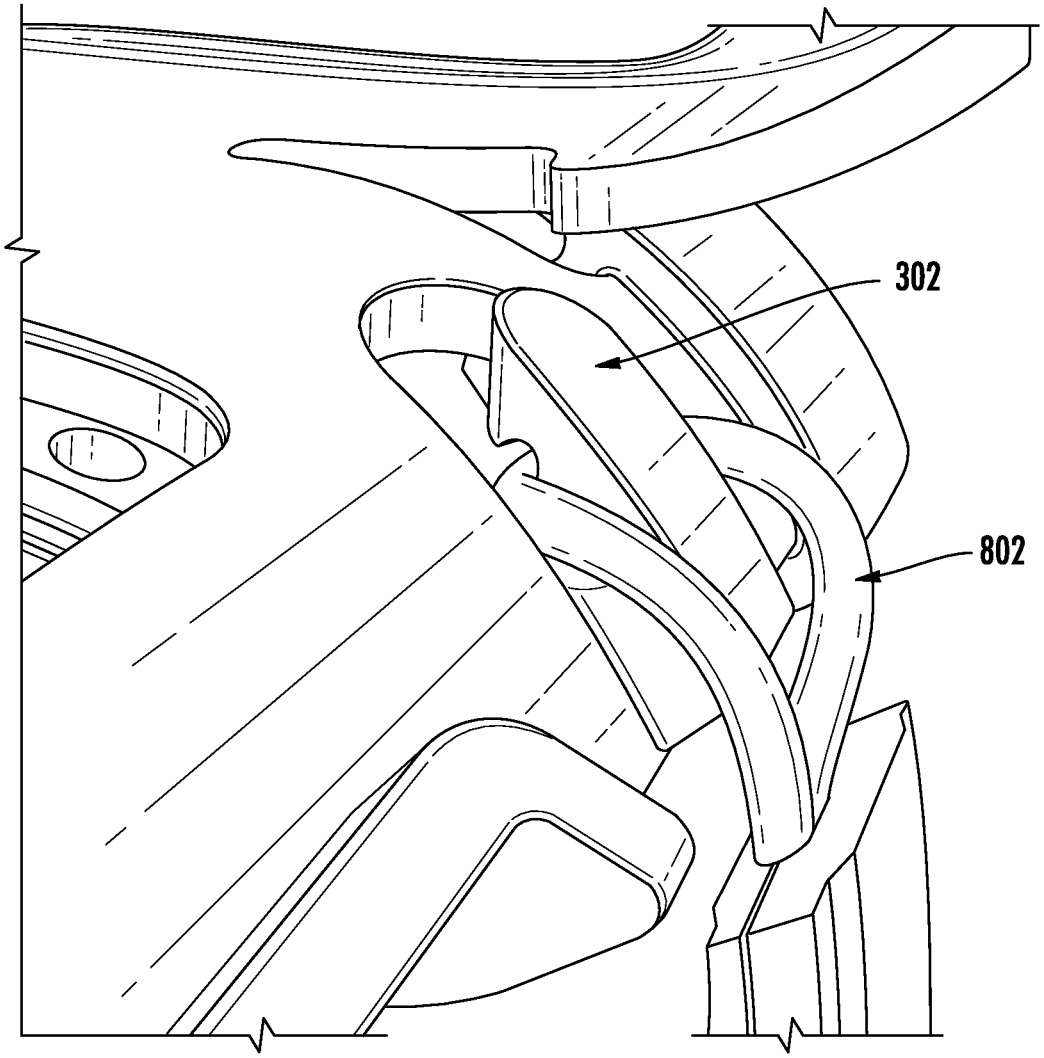
FIG. 9 illustrates a perspective view of a loop of cord attached to a fastening assembly in accordance with an example embodiment of the present disclosure.

FIG. 9 illustrates a perspective view of a single loop of cord 802 attached to a fastening assembly 102 by passing the loop over the tab 302 and pulling the loop through the narrow gap 702 defined between the tab 302 and the inner body 104 according to the various embodiments discussed herein.

As depicted in FIG. 9, the cord 802 used to attach to the fastening assembly 102 may be configured to form a loop. The loop of cord 802 may be any cord, string, or material (or combination of materials) that forms a closed loop with an opening such that the cord, string, or material may be passed over the top of a tab 302 of a fastening assembly 102. In some embodiments, the loop of cord 802 may be a braided, interlocked elastic material with nylon coating, comprising a durable and abrasion resistant material to reduce wear and increase product life. In some embodiments, the loop may comprise various materials, for example, a cord 802 may be a length of cord that is attached at both ends to a band 1004 or an intermediate portion of a fastening mechanism 1002 (e.g., branched structure 1006), forming a loop comprising the cord 802 attached at each end to the band assembly. While depicted in some embodiments as an elastic cord, the cord used herein, including to form the loop shown in FIG. 9, may be any piece of material, rope, cord, or other similar structure capable of passing over a tab 302 and through the gap 702 defined between the inner body 104 and the tab 302, whether elastic or inelastic. By forming the cord 802 into a loop, the loop of cord 802 may be easily pulled through the gap 702 by pulling at one point of contact, allowing the user to pass the loop of cord 802 over the tab 302 and pull the cord 802 through the gap 702 using only one hand.

Figure 10:
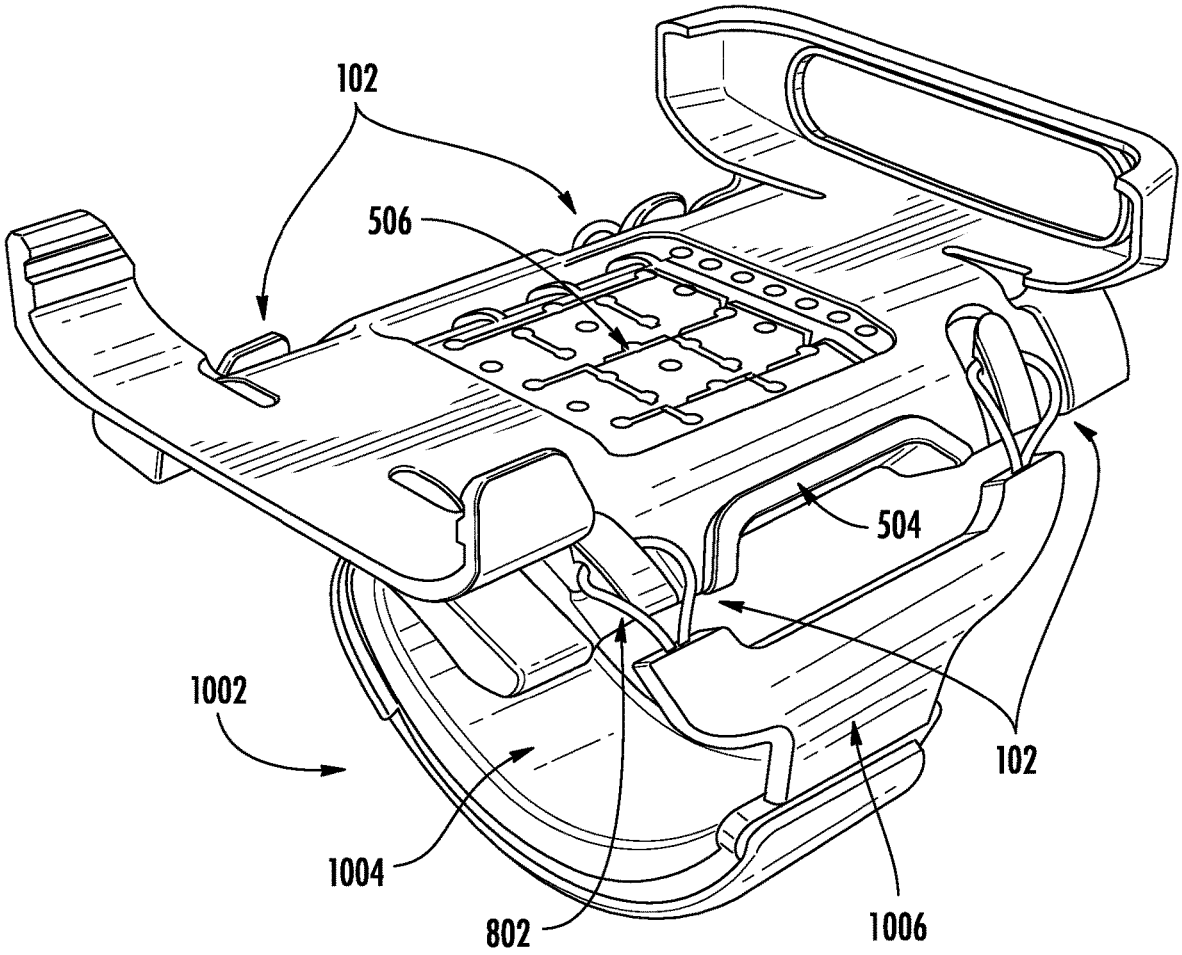
FIG. 10 illustrates a perspective view of a device holder and a strapping mechanism in accordance with an example embodiment of the present disclosure.

FIG. 10 illustrates a perspective view of an example embodiment of the device holder 100 and a strapping mechanism 1002, wherein the strapping mechanism 1002 comprises a band 1004 attached to two branched structures 1006, one on each end of the band 1004 and attached to the band via a rectangular metal or plastic ring. Each end of the branched structure 1006 terminates in a loop of cord 802, defining four loops of cord 802, each aligned with and configured to engage four tabs 302 formed as part of a single outer body 106. In addition, the depicted strapping mechanism 1002 includes a band 1004 connecting the four loops of cord 802. In some embodiments, the cord 802 may extend within the branched structure 1006 and/or band 1004 to define two or more loops from a single, contiguous piece of cord. In some embodiments, the cord(s) 802 may attach directly to the band 1004 or another strapping mechanism for holding the outer and inner bodies on the object (e.g., the user's arm).

FIG. 10 illustrates a strapping mechanism 1002 in accordance with an example embodiment of the present disclosure. A strapping mechanism 1002 may be any material or structure designed to attach to one or more fastening assemblies 102 and pass around an object (e.g., user's arm 804) securing the device holder 100 to the object. In some embodiments, such as depicted in FIG. 10, the strapping mechanism 1002 may include a band 1004. A band 1004 can be any structure designed to comprise at least one cord 802 and pass under the user's arm 804 attaching the device holder 100 to the user's arm. In some embodiments, the band 1004 may be a sleeve, strap, belt, band, fastener, or any other portion(s) of material(s) capable of securing the device holder 100 to an object (e.g., user's arm 804) by wrapping at least partly around the object to hold the inner body 104 and outer body 106 against the object or an intermediate surface between the inner body 104 and/or outer body 106 and the object. In some embodiments, the band 1004 may partly or entirely comprise the cord 802 used to fasten the strapping mechanism 1002 to the one or more fastening assemblies 102. In some embodiments, the band 1004 may comprise a material intended to comfortably contact a user's arm 804, for example, a sleeve, a fabric, a breathable material, or similar fabric or material. In some embodiments, the band 1004 may include padding or other material adjacent to the user's arm 804 to provide comfortable contact with the user's arm 804.

As shown in FIG. 10, the strapping mechanism 1002 may terminate in two branched structures 1006. Each branched structure 1006 may further comprise two loops of cord 802 defining a total of four loops of cord 802 designed to couple with four or more fastening assemblies 102. For example, the strapping mechanism 1002 may include two loops of cord 802 attached to the branched structure 1006 on one end of the band 1004 designed to attach to two fastening assemblies 102 on one side of the device holder 100 and pass under the user's arm 804. The strapping mechanism 1002 may further include two more loops of cord 802 on the other end of the band 1004 designed to attach to two more fastening assemblies 102 on the opposite side of the device holder 100. In some embodiments, the branched structure 1006 may comprise a single piece of cord 802 that spans across the tabs 302 on one side of the outer body 106 to form both end loops. In some such embodiments, each side of the outer body may use a single piece of cord for two total cords. In some embodiments, only a single fastening assembly 102 and corresponding loop 802 may be used on each side of the device holder 100. In some embodiments, more than two fastening assemblies 102 and corresponding loops 802 may be used on each side of the device holder 100. In some embodiments, a strapping mechanism 1002 may only have one or more loops of cord 802 on one side of the band 1004, the other side of the band 1004 being attached either permanently or using another attaching mechanism to the device holder 100. In such an embodiment, a user may attach the strapping mechanism 1002 simply by passing the band 1004 under the user's arm 804 and attaching the one or more loops of cord 802 to the one or more fastening assemblies 102 positioned on the device holder 100. In some embodiments, the strapping mechanism 1002 may also include a tightening mechanism providing a means to tighten the strapping mechanism 1002 against a user's arm 804. This may be, for example, a looped strap with an adhesion device allowing a user to tighten and fasten the strapping mechanism 1002 in place. Utilizing the strapping mechanism 1002 to tighten the device holder 100 against the user's arm 804 further closes the gap between the inner body 104 and the tab 302 as described above, which may aid with locking the cord 802 in an attached position. Moreover, multiple strapping mechanisms may be used to secure the device holder to the object (e.g., two parallel straps between opposing pairs of fastening assemblies) without departing from the scope of the present disclosure.

Figure 11:
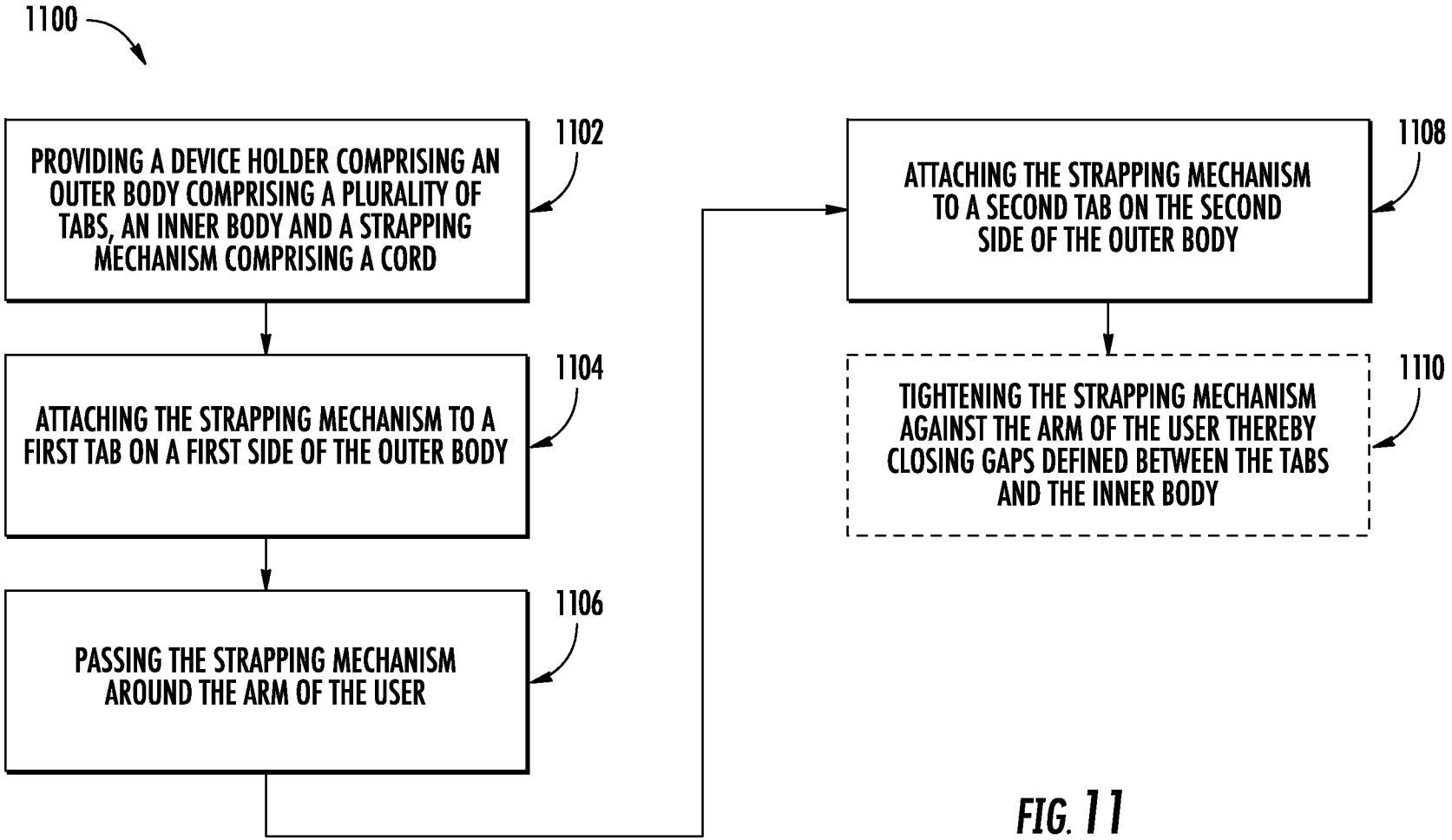
FIG. 11 depicts a flowchart illustrating operations performed to attach a device holder to a user's arm in accordance with an example embodiment of the present disclosure.

FIG. 11 provides a flowchart illustrating an example process 1100 for attaching a device holder to a user's arm 804.

The process 1100 begins at block 1102, by providing a device holder 100 comprising one or more fastening assemblies 102 and a strapping mechanism 1002 comprising a cord 802. As described in the embodiments of FIGS. 1-10, a device holder 100 may comprise one or more fastening assemblies 102 providing a mechanism to securely attach a mobile device 110 to an object (e.g., a user's arm 804).

The process 1100 continues at block 1104, by attaching the strapping mechanism 1002 to the at least one fastening assembly 102 on the first side of the outer body 106. As described in FIG. 3, in some embodiments, a device holder 100 may be comprised of multiple fastening assemblies 102 disposed on a single outer body 106. The process of attaching a device holder 100 may include attaching one side of the strapping mechanism 1002 to a first side of the outer body 106. In some embodiments, the process may require attaching one side of the strapping mechanism 1002 to one or more fastening assemblies 102 on the first side of the outer body 106, while in other embodiments, the strapping mechanism 1002 may be permanently attached to the first side of the outer body 106.

The process 1100 continues at block 1106, by passing the strapping mechanism 1002 around the arm of the user. As described in FIG. 10, the strapping mechanism 1002 may include a band 1004, such as a sleeve, strap, belt, band, fastener, or any other portion(s) of material(s) capable of facilitating securing the device holder 100 to a user's arm 804. The band 1004 may comprise material intended to provide a comfortable and/or breathable material, securely attaching a mobile device 110 while maintaining comfortable contact with the user's arm 804 and allowing airflow to the portions of the user's arm 804 in contact with the band 1004.

The process 1100 continues at block 1108, by attaching the strapping mechanism 1002 to the at least one fastening assembly 102 on the second side of the outer body 106. A device holder 100 may provide one or more fastening assemblies 102 disposed on a second side of the outer body 106 providing attachment locations for a cord 802 or loop positioned on the strapping mechanism 1002. Attaching the cord 802 or loop to the fastening assemblies 102 disposed on the second side of the outer body 106 may complete attachment of the device holder 100 to the user's arm 804.

The process 1100 may conclude at block 1110, by tightening the strapping mechanism 1002 against the arm of the user thereby closing gaps 702 defined between the tabs 302 and the inner body. As described in FIG. 10, the strapping mechanism 1002 may have a tightening mechanism, allowing a user to securely tighten the device holder against the user's arm 804. As the strapping mechanism 1002 is further tightened, the gap 702 between the tab 302 and the rib 502 of the inner body 104 further closes, locking the cord 802 or loops of cord 802 of the strapping mechanism 1002 into the one or more fastening assemblies 102.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved.

Although specific terms are employed herein, they are used in a generic and descriptive sense only and not for purposes of limitation.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. The disclosed embodiments relate primarily to a mobile device holder, however, one skilled in the art may recognize that such principles may be applied to any apparatus that must be attached to an appendage or other surface, for example, armguards, shin guards, leg guards, elbow pads, and/or other similar apparatus. Alternative embodiments that result from combining, integrating, and/or omitting features of the embodiment(s) are also within the scope of the disclosure. Accordingly, the scope of protection is not limited by the description set out above.

Use of broader terms such as "comprises," "includes," and "having" should be understood to provide support for narrower terms such as "consisting of," "consisting essentially of" and "comprised substantially of" Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

The invention claimed is:

1. A fastening assembly comprising:

a tab defining a distal end and a proximal end, the proximal end connected to a portion of an outer body, the tab comprising a first material; and an inner body defining a gap between the tab and a portion of the inner body, the inner body comprising a second material, wherein the first material and second material are different;

wherein the inner body and the tab are configured to receive a cord therebetween, wherein at least the portion of the inner body is configured to deform during insertion of the cord between the tab and the inner body, and wherein the gap between the tab and the portion of the inner body is closed by applying pressure to the fastening assembly, wherein said pressure is applied to the fastening assembly by at least connecting the cord to the tab, wherein the cord is attached to a band of a strapping mechanism.

2. The fastening assembly of claim 1, wherein the tab defines a first protrusion at or proximate the distal end, the first protrusion extending at least partially towards the inner body.

3. The fastening assembly of claim 1, wherein the portion of the inner body comprises a second protrusion, and wherein the second protrusion is configured to deform at least partially towards the proximal end of the tab during insertion of the cord.

4. The fastening assembly of claim 1, further comprising the cord, wherein the cord is configured to be pulled between the tab and the inner body to deform the portion of the inner body.

5. The fastening assembly of claim 4, wherein the gap is smaller than the width of the cord.

6. The fastening assembly of claim 1, wherein the portion of the inner body comprises a rib extending between two other portions of the inner body.

7. The fastening assembly of claim 6, wherein the rib extends perpendicular to a longitudinal axis of the tab.

8. The fastening assembly of claim 6, wherein the rib is configured to remain fixed to the two other portions at opposite ends of the rib while a middle portion between the opposite ends is configured to deform along at least an upper edge of the rib.

9. The fastening assembly of claim 1, wherein the tab is comprised of a rigid plastic and the inner body is comprised of an elastomeric material.

10. The fastening assembly of claim 1, wherein the tab is a single integral piece with the outer body.

11. A device holder, comprising:

an outer body comprising a tab defining a distal end and a proximal end, the proximal end connected to a portion of the outer body, the tab comprising a first material; and an inner body comprising a second material, wherein the first material and second material are different;

wherein the inner body and the tab are configured to receive a cord therebetween, wherein at least a portion of the inner body is configured to deform during insertion of the cord between the tab and the inner body, and wherein the outer body comprises a device carriage configured to hold a mobile device therein; and a strapping mechanism comprising the cord;

wherein the strapping mechanism is configured to attach the device holder to an object, and wherein a gap between the tab and the portion of the inner body is closed by applying a pressure to the outer body, wherein said pressure is applied to the outer body by at least connecting the cord to the tab.

12. The device holder of claim 11, further comprising four tabs, including the tab connected to the outer body;

wherein the strapping mechanism is configured to engage each of the four tabs.

13. The device holder of claim 12, wherein the strapping mechanism further comprises:

a portion of material having a first end and a second end; and four loops of cord, including the cord, wherein two of the four loops of cord are disposed at or proximate the first end and a second two of the four loops of cord are disposed at or proximate the second end, wherein each of the four loops of cord is configured to engage a respective one of the four tabs.

14. The device holder of claim 11, wherein the cord of the strapping mechanism comprises a loop; wherein the loop is configured to engage the tab by being disposed over the distal end of the tab.

15. The device holder of claim 11, wherein the strapping mechanism further comprises:

a band; and at least one loop of cord attached to the band;

wherein the at least one loop of cord is configured to engage the tab and the band is configured to pass around the object.

16. The device holder of claim 15, further comprising:

a second tab, wherein the object comprises a user arm and wherein the tab is disposed on a first side of the outer body and the second tab is disposed on a second side of the outer body opposite the first side, and wherein the tab and the second tab are oriented in different directions;

wherein the strapping mechanism is configured to attach to the tab disposed on the first side of the outer body, pass around the user arm, and attach to the second tab disposed on the second side of the outer body; and wherein the gap between the tab and the inner body is closed when the strapping mechanism is tightened against the user arm, wherein the strapping mechanism is tightened against the user arm by at least connecting each of at least one loop of cord that is attached to the band of the strapping mechanism to the tab and the second tab.

17. A method of attaching a device to an arm of a user, the method comprising:

providing a device holder, comprising:

an outer body comprising a plurality of tabs, including a first tab and a second tab, the plurality of tabs defining a distal end and a proximal end, the proximal end connected to a portion of the outer body, the plurality of tabs comprising a first material, wherein the first tab is disposed on a first side of the outer body and the second tab is disposed on a second side of the outer body opposite the first side;

an inner body comprising a second material, wherein the first material and second material are different;

wherein the inner body and the first tab are configured to receive a cord therebetween, wherein at least a portion of the inner body is configured to deform during insertion of the cord between the first tab of the plurality of tabs and the inner body, and wherein the outer body comprises a device carriage configured to hold a mobile device therein; and a strapping mechanism comprising the cord; the method further comprising:

passing the strapping mechanism around the arm of the user;

attaching the strapping mechanism to the first tab and the second tab; and tightening the strapping mechanism against the arm of the user thereby closing gaps defined between each of the plurality of tabs and the inner body, wherein tightening the strapping mechanism against the arm of the user is caused by at least:

connecting each of the cord that is attached to a band of the strapping mechanism to each of the plurality of tabs.

* * * * *